US005501269A

United States Patent [19]

Jenkins

[11] Patent Number: 5,501,269

[45] Date of Patent: Mar. 26, 1996

[54] CONDENSER UNIT

[76] Inventor: Robert E. Jenkins, 2903 Hillview Rd., Austin, Tex. 78703

[21] Appl. No.: 111,570

[22] Filed: Aug. 25, 1993

[51] Int. Cl.[6] ..... F28B 1/00

[52] U.S. Cl. ..... 165/110; 62/305; 165/111; 165/162; 165/163; 165/120

[58] Field of Search ..... 165/117, 111, 165/162, 163, 167, 120, 76, 110; 62/305

[56] References Cited

U.S. PATENT DOCUMENTS

| | | | |
|---|---|---|---|
| 3,141,308 | 7/1964 | Dark | 62/305 |
| 3,472,042 | 10/1969 | Shriver et al. | 62/305 |
| 3,720,259 | 3/1973 | Fritz et al. | 165/163 X |
| 4,028,906 | 6/1977 | Gingold et al. | 62/305 X |
| 4,202,409 | 5/1980 | Cann et al. | 165/122 |
| 4,387,766 | 6/1983 | Miller | 165/163 X |
| 4,440,893 | 4/1984 | Kallenback et al. | 524/305 |
| 4,918,943 | 4/1990 | Faust | 62/305 |
| 4,974,422 | 12/1990 | Kocher | 62/305 |
| 5,046,331 | 9/1991 | O'Neal et al. | 62/305 X |
| 5,052,474 | 10/1991 | Bronnert | 165/162 X |

*Primary Examiner*—John Rivell
*Assistant Examiner*—Christopher Atkinson
*Attorney, Agent, or Firm*—G. Turner Moller

[57] ABSTRACT

A housing is provided for an air conditioning condenser of the type providing a fan creating an upward path of air movement through the housing, a heat exchange coil having and inlet and an outlet for connection to a source of hot refrigerant in a refrigerant loop and means for spraying water on the coil. The housing is made of rotomolded plastic and comprises a base, a plurality of identical walls and a top. The base and top are rotocast as a single piece and then cut horizontally with a saw to provide the two pieces. The base includes a U-shaped foot arranged to receive fork lift tines and oriented so the fork lift does not damage the inlet and outlet to the heat exchange coils.

22 Claims, 5 Drawing Sheets

CONDENSER UNIT

This invention relates to an improved condenser housing for air conditioning units and more particularly to a housing for a condenser of the type shown in application Ser. No. 07/973,301, filed Nov. 9, 1993, entitled CONDENSING UNIT, the disclosure of which is incorporated herein by reference.

There are many different types of condensing units used in refrigeration systems which term is intended to include air conditioning systems. The standard smaller unit is an air cooled system in which hot gaseous refrigerant flows into a heat exchanger and a fan blows air across the heat exchanger to give up heat to the atmosphere. These systems are commonly found in residences and small to medium sized buildings.

Air cooled units suffer a substantial disadvantage as the ambient temperature rises because they depend entirely upon the differential between the ambient temperature and the refrigerant temperature. Consequently, when additional capacity is required, it is more difficult to give up heat from the hot gaseous refrigerant to the atmosphere. For example, condensing units mounted on the roof of grocery stores in the southwest have a substantial problem. When the recorded temperature at the airport in the shade is 100° F., the temperature on an asphalt-gravel roof in the sun might be 125° F. Air cooled condensing units are rated assuming the ambient temperature is 95° F. The capacity of air cooled refrigeration systems thus drops off substantially at higher temperatures for a variety of interrelated reasons, all of which have their root cause in the increasing difficulty of giving off heat to hotter air.

Air cooled condensing units also have operational and maintenance problems because of the necessarily fragile heat exchanger fins or surfaces which are exposed to the elements. Thus, standard aluminum fins lose heat transfer efficiency over time because of corrosion, fouling and deformation due to wind blown debris and the like. Conventional heat exchangers are particularly short lived in salt water environments near coastlines. Despite their shortcomings, it is difficult to contend that air cooled units are poorly conceived or poorly executed because, to date, they have been the standard of the industry in small capacity units.

Large units typically used for office buildings have a cooling tower in which the condensing coils are submerged in a coolant, almost always water. These large water cooled units have many advantages. They are substantially more efficient, particularly at high ambient temperatures because the cooling water is mostly cooled by evaporation and thus can be substantially cooler than ambient temperature. Water cooled units incorporating a cooling tower also have their disadvantages, many of which have to do with testing and treating the cooling water for a variety of suspended materials, pH, bacteria, fungi and algae. It is normal for water cooled units to require an individual on site during most of the operating day to oversee operations. In addition, cooling towers collect an astonishing variety and quantity of sludge in the bottom of the tower which must be periodically removed.

Another class of condensing systems for refrigeration systems incorporates one or more heat exchangers which are sprayed with a coolant, usually water. Most prior art systems have theoretical advantages because most of the cooling that occurs is due to evaporation of the sprayed water which allows condensing temperatures below ambient. Experienced refrigeration people shudder at the thought of sprayed water condensing systems because of water problems, scale buildup on the coils, algae and fungi growth in the device and the like. It is this class of devices that this invention most nearly relates.

Of some interest relative to this invention are the disclosures in U.S. Pat. Nos. 4,202,409; 4,380,263; 4,723,419; 4,819,448 and 5,046,331.

The housing of this invention is used as part of a condenser in conventional refrigeration systems or as a condenser/evaporator in heat pump type systems. The housing provides a variety of advantages and savings. For example, the heat exchange coils and other interior mechanisms are suspended on an internal self supporting frame so the top and walls can be independently removed to expose the mechanism. Specifically, a lip of the walls rests inside a lip provided by the base so only a modest amount, if any, of additional fastening is required. In addition, the coolant inlet and outlet conduits extend through the base and then pass upwardly to the coils to allow the walls to be easily removed. This has a variety of advantages. First, the device is quite easy to assemble and maintain because the walls and top can be readily removed. Second, the assembled device can be disassembled with simple hand tools so it can pass through a standard 36" door which is very desirable for awkward access locations.

The frame is not connected to the base, instead it rests in the base. This also makes the condenser very easy to assemble and to disassemble for installation. The supporting frame is preferably tubular to provide both support and the water conduit leading to the spray nozzles. Thus, the frame provides multiple functions at little cost.

The housing panels include spaced inside and outside walls and are made by rotomolding. This makes for a very stout assembly and is quite inexpensive. The spaced inside and outside walls provide a long air passage leading downwardly into the bottom of the housing and effectively prevent sunlight from shining into the water sump so algae growth is inhibited. The air passage inlets are quite high off the ground thereby reducing the amount of dust and wind blown debris entering the air passage. The spaced walls also provide a measure of sound deadening and, when the device is shut down, a measure of insulation to retard freezing of water in the housing.

In addition, the housing has one or more feet raising it off the ground so fork lift tines can directly contact the housing rather than buying a pallet and temporarily strapping the housing to the pallet. The feet are arranged so the fork lift tines have to slide under the housing in a predetermined direction so they cannot contact the coolant conduits. In one preferred arrangement, a U-shaped rib on the bottom of the housing provides the tine directing foot and, on the inside of the bottom, provides a groove in the sump. The groove is shaped to assist discharging scale and debris from the sump. In another preferred arrangements, a pair of wooden sills extend under the bottom and provide a lifting attachment.

It is accordingly an object of this invention to provide an improved refrigeration condenser.

A further object of this invention is to provide an improved housing for a refrigeration condenser.

Another object of this invention is to provide a housing for a refrigeration condenser that is easy to assemble and disassemble and will pass through a standard 36" door.

A further object of this invention is to provide a condenser housing having a frame supporting heat exchange coils, the frame resting in the housing.

These and other objects of this invention will become more fully apparent as this description proceeds, reference being made to the accompanying drawings and appended claims.

Figure 1:
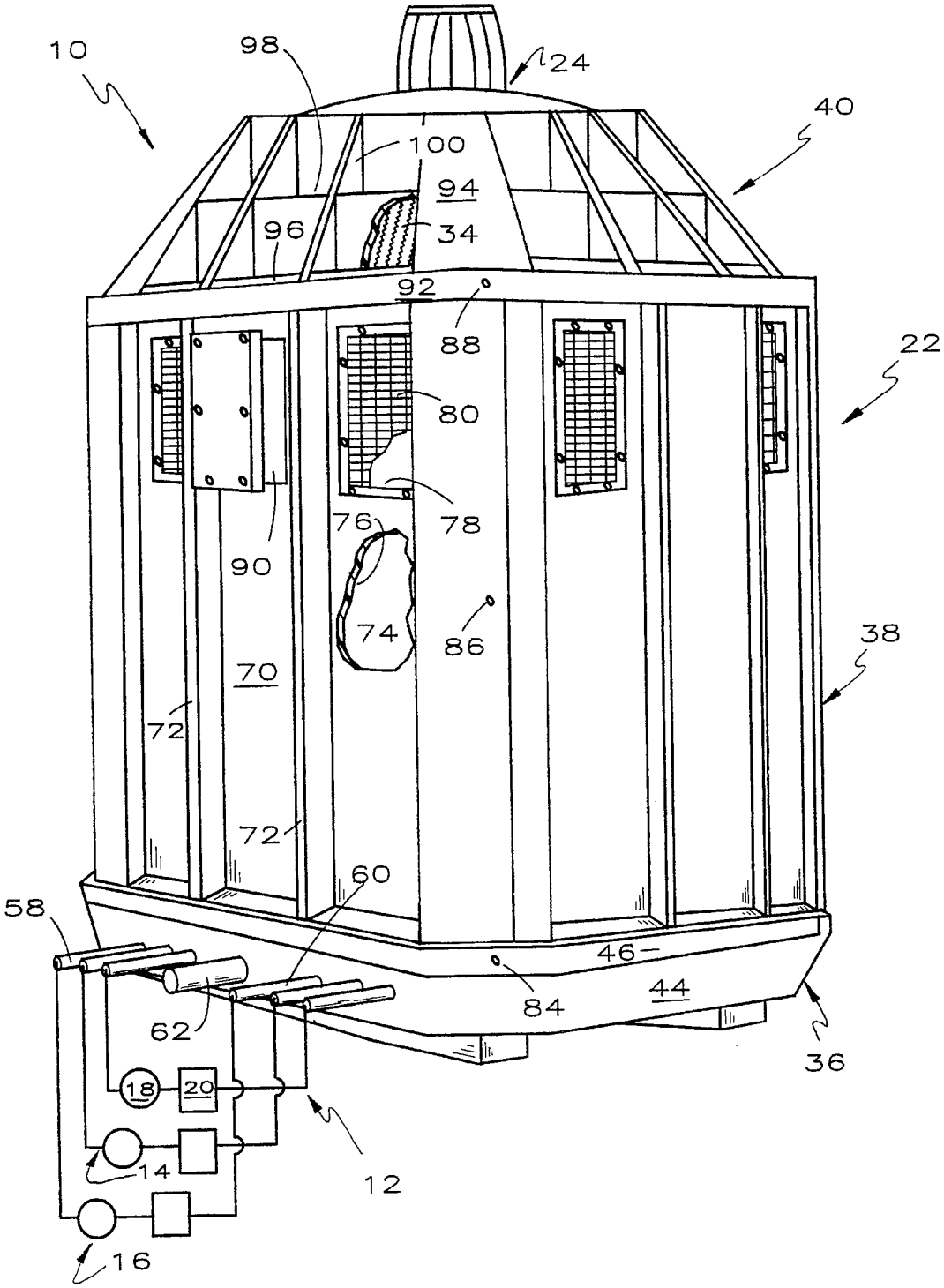
FIG. 1 is an isometric view of a condenser housing of this invention shown schematically in connection with a plurality of refrigeration systems.

Referring to FIGS. 1–8, a condensing unit 10 of this invention is illustrated in combination with a plurality of refrigeration and/or air conditioning systems 12, 14, 16. Each of the refrigeration systems 12, 14, 16 circulates a refrigerant material, such as ammonia, propane, Freon, or the like, through a compressor 18, an evaporator 20 and the condensing unit 10 of this invention.

The condensing unit 10 of this invention comprises, as major components, a housing 22, a fan assembly 24 for moving air upwardly through the housing 22, a plurality of upper condensing coils 26 and lower condensing coils 28 for condensing the hot gaseous refrigerant from the refrigeration systems 12, 14, 16, a water circulation system 32 and a spray or drift eliminator 34.

The fan assembly 24, the condensing coils 26, 28, the water circulation system 32 and the drift eliminator 34 may be of any suitable type but preferably are as shown in copending application Ser. No. 07/973,301. In addition, surface media 30 may be placed between the upper and lower coils 26, 28 if desired.

The housing 22 provides an upwardly directed air path and a downwardly directed water spray path that are substantially shaded against direct sunlight. The housing 22 is of unibody type construction including a base 36, a series of vertical opaque substantially identical load bearing walls 38 and a top 40.

The housing 22 is made by rotocasting or rotomolding which is a term of art describing a technique where a quantity of organic monomer is placed in a mold which is heated and rotated. The monomer splashes against the heated mold so it polymerizes on the interior of the mold leaving a double walled piece having an external shape dictated by the shape of the mold. There is no interior plug in the mold so the configuration on the inside of the piece is a reflection of outside. The walls of this invention are preferably identical so that only one mold is required for the four walls. The top and bottom are cast as one piece and then cut apart with a saw. Thus, a finished housing having six pieces, i.e. four walls, a top and a bottom, is made with only two molds.

The base 36 comprises a bottom wall 42 and a short peripheral wall 44 having an outwardly offset lip 46. The underside of the bottom wall 42 is shown best in FIG. 3 and provides a generally U-shaped foot 48 extending downwardly from the bottom wall 42. The foot 48 provides a pair of parallel legs 50 and a base 52 connecting the legs 50. The legs 50 are spaced relative to the periphery of the bottom wall 42 so that a pair of fork lift tines 54 may be placed on the outside of the legs 50 as shown or on the inside. It will be seen that the tines 54 can extend around the foot 48 only if the tines 54 are inserted in the direction shown by the double headed arrow 56. This is of considerable importance because the coolant inlet and outlet conduits 58, 60 and water inlet conduit 62 extend perpendicularly to the arrow 56. Thus, the arrangement of the foot 48 prevents a fork lift driver from trying to insert the tines 54 in a direction that will damage the conduits 58, 60, 62.

As shown best in FIG. 2, the base 36 provides a sump 64 comprising part of the water circulation system 32 as more fully explained hereinafter. Because the shape of the inside of the bottom wall 42 is a reflection of the shape of the outside, the inside of the foot 48 provides a U-shaped channel 66 which is advantageously used to purge debris from the sump 64.

The corners of the base 36 are at an angle relative to the sides and provide a pair of supports 68 for supporting the walls 38 as will be more fully apparent hereinafter.

As previously mentioned, the walls 38 are preferably identical. The walls 38 include a more-or-less planar front panel 70 and may have one or more strengthening ribs 72 therein and an arcuate back panel 74 (FIG. 5) providing an air passage 76 therebetween. The walls 38 provide a pair of inlet openings 78 which may be covered by a screen mesh cover 80 and a pair of outlet openings 82 in the end of the upright wall 38. The inlet openings 78 are preferably quite high on the housing 22 to minimize entry of dust or other wind blown debris. The openings 78, 82 are positioned so sunlight from any location above the horizon cannot pass directly through the openings 78, 82 into the interior of the housing 22. On reflection, it will be seen that the opening 78 is preferably above the opening 82. If the opening 82 were uppermost, the housing 22 would have to be taller for not much purpose. Because sunlight cannot pass directly through the drift eliminator 34, the air inlet openings 78, 82 are staggered and the housing walls and bottom are opaque, the housing 22 is dark inside. This substantially prevents algae growth because almost all algae require sunlight to survive.

Figure 5:
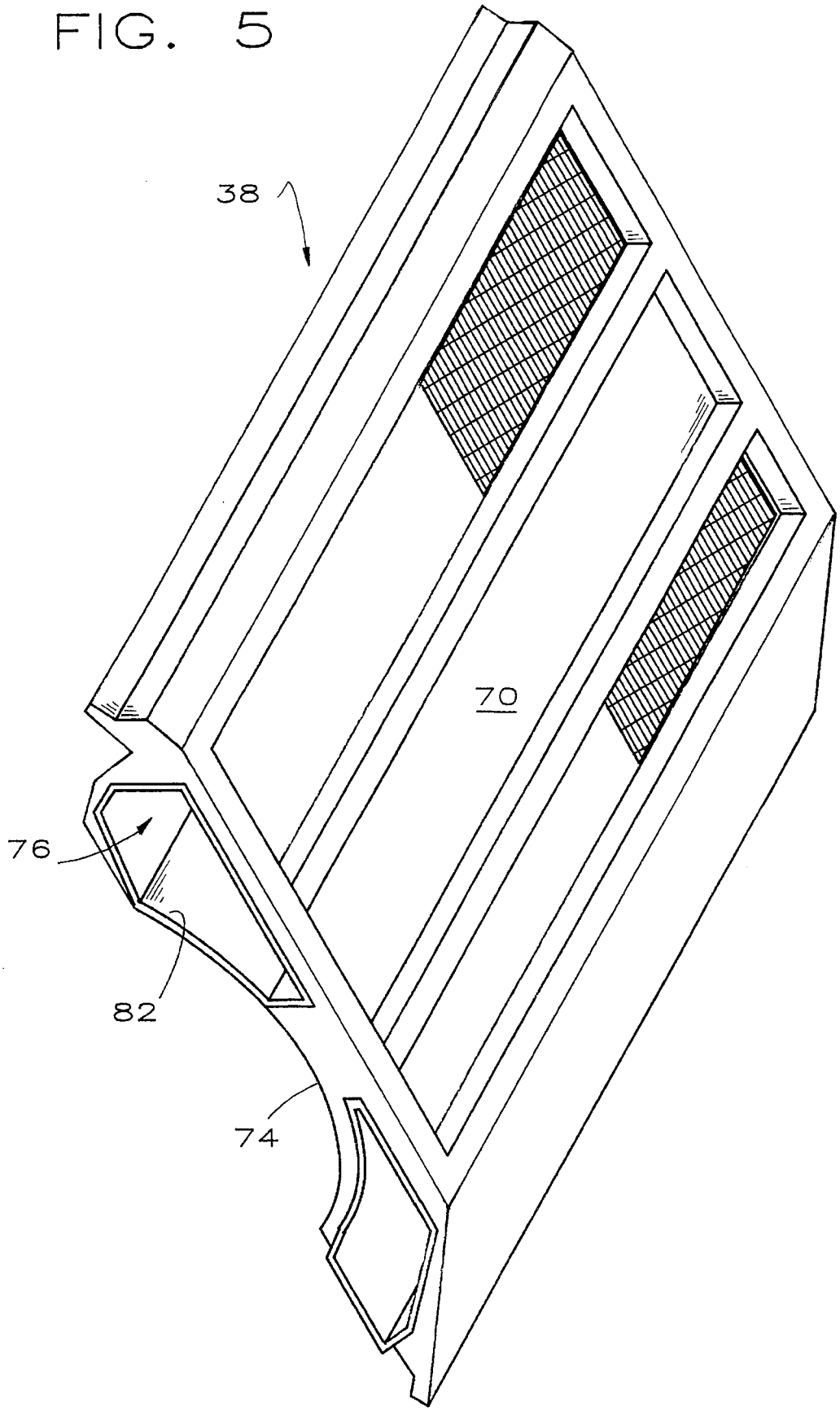
FIG. 5 is an isometric view of one of the side walls, illustrating the bottom thereof.

As shown best in FIGS. 1 and 5, the ends of the walls 38 are at an angle to the sides of the housing 22 and are parallel to the corners of the base 36. When the walls 38 are in place on the base 36, the walls 38 are inside the lip 46.

Preferably, the walls 38 are connected to the base by a fastener 84 at each corner, to each other by a fastener 86 and to the top 40 by a fastener 88. An electrical panel 90 may be attached to one of the walls 38.

The top 40 includes an outer lip 92 overlying the walls 38 and a top wall 94 providing a pair of steps 96, 98 interrupted on the exterior by ribs 100. The drift eliminator 34 is positioned between the steps 96, 98 and secured in any suitable fashion. The fan assembly 24 is mounted in a recess in the apex of the housing 22. It will accordingly be seen that the condensing unit 10 provides a upwardly moving air stream so air passes downwardly through the inlets 78 and then upwardly inside the housing 22 to escape through the fan assembly 24.

Figure 2:
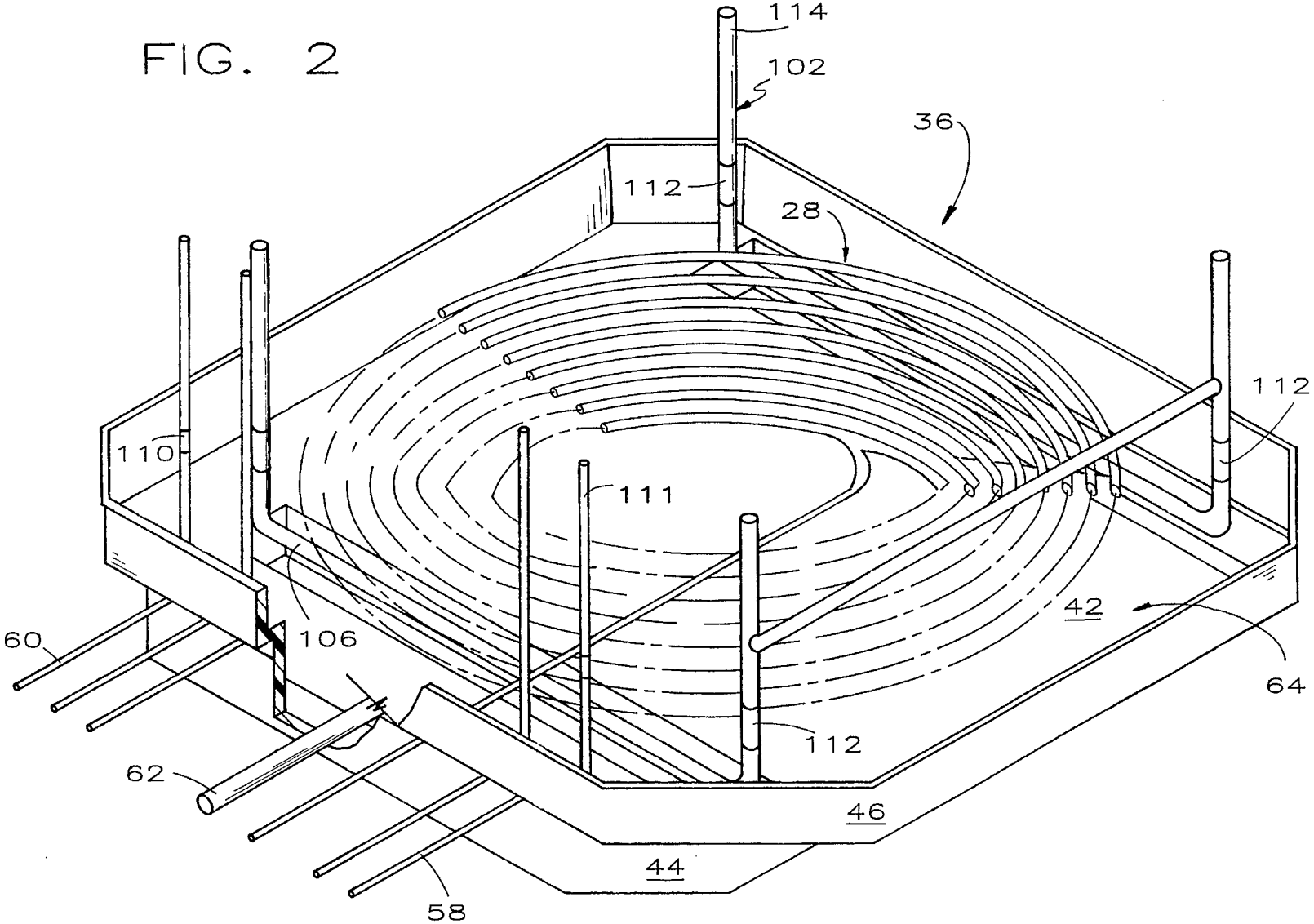
FIG. 2 is an isometric view of the base of the condenser housing of FIG. 1.
Figure 4:
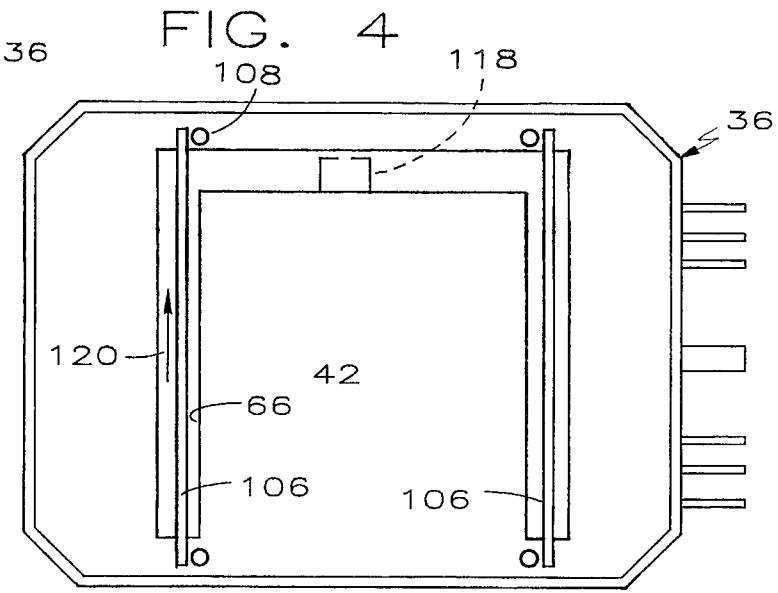
FIG. 4 is a top plan view of the base showing the debris removing channel and the position of the coil support frame.
Figure 3:
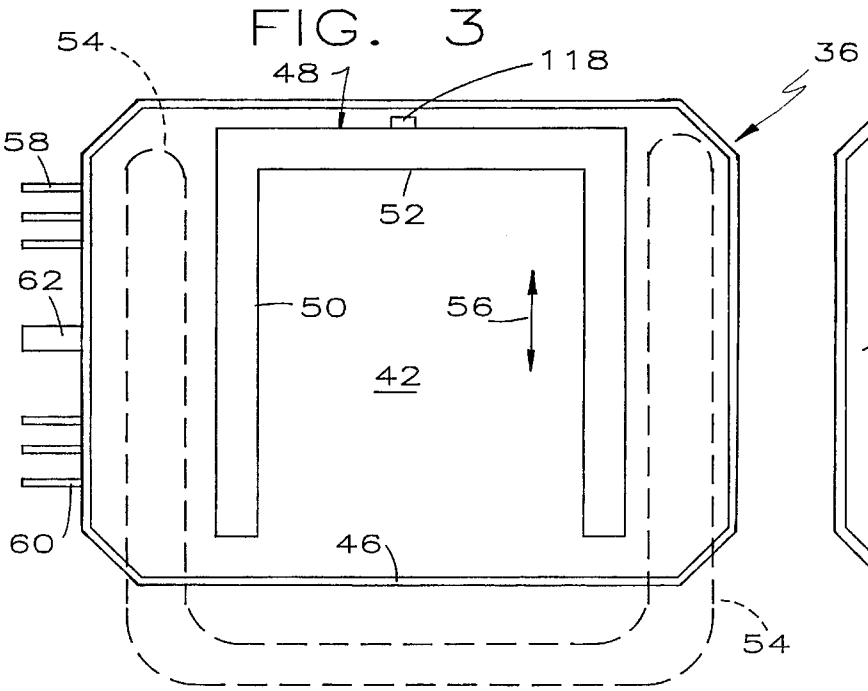
FIG. 3 is a bottom plan view of the base showing the arrangement of the supporting foot.
Figure 6:
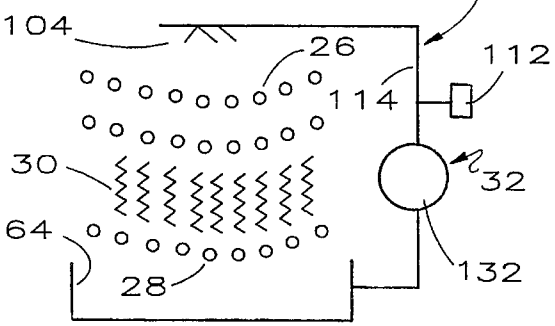
FIG. 6 is a schematic view of the water circulation system of this invention.

As shown best in FIGS. 2, 4 and 6, a frame 102 supports the upper and lower coils 26, 28. Preferably, the frame 102 is tubular and provides a first flow path for the recirculated water being delivered to the nozzles 104 and sprayed onto the coils 26, 28. The frame 102 includes a pair of tubular horizontal lower supports 106 parallel and straddling the legs of the channel 66. As shown best in FIG. 5, the back panels 74 each provide a quadrant of a circle and rather closely embrace the frame 38. Although the frame 102 is movable relative to the base bottom wall 42, there is not much tendency of the frame 102 to shift laterally because it contacts the inside of the walls 38. However, if lateral shifting is of concern, one or more sets of shoulders 108 are provided in the base 36 to abut the frame 102 and prevent it from shifting laterally relative to the base 36. The refrigerant inlets 58 and the refrigerant outlets 60 extend through the base 36 and may connect, through a releasable coupling 110, to a vertically extending conduit 111 leading to the coils 26, 28. Because the frame 102 is not connected to the housing top 40 or the walls 38, the top 40 and walls 38 may be easily removed from the base 36. The vertical joints in the frame 102 can be left uncemented because the housing top 40, when in place, is constructed so as to restrict any upward movement of the frame 102. Water leaks, if any, that may occur at those joints are inconsequential since wetting the internal components of the unit is one of the functions of the frame 102. These uncemented joints allow the coil 26 to be removed along with a section of the frame in modular fashion.

Preferably, the frame/coil modules are less than 36" high so they can pass through a standard 36" door. Heretofore, many roof top installations were made using a crane to hoist the condenser to the roof top because the access door between the service stairs and the roof is a single width 36" door. In this invention, the installer can remove the top 40 and the walls 38 from the base 36. Then the frame/coil modules can be removed from the base 36. These four housing modules and the frame/coil modules can then be carried up a standard stairwell and through a standard 36" door leading to a roof top installation rather than using a crane.

Figure 7:
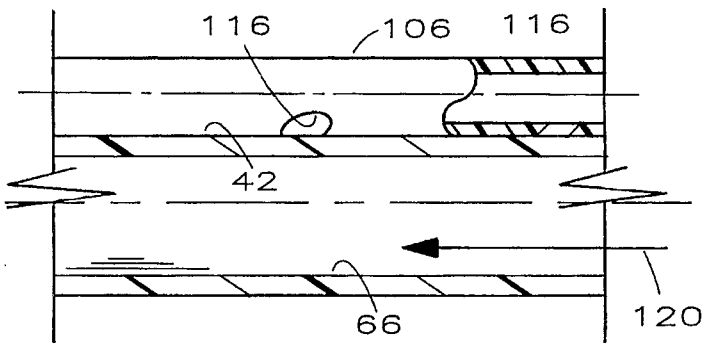
FIG. 7 is an enlarged cross-sectional view of FIG. 4, taken substantially along line 7—7 thereof as viewed in the direction indicated by the arrows.

It will be seen that the supports 106 are positioned above the legs of the channel 66. The tubular supports 106 provide a second flow path, separate from the first flow path, for purging the sump 64. This may be accomplished by providing a plug 112 in a vertical support 114 (FIG. 2) so that water injected into the support 114 above the plug 112 is sprayed onto the coils 26, 28 and water injected into the support 114 below the plug 112 is discharged out of the supports 106. Openings 116 are provided in the supports 102 to discharge purge water from a pump (not shown) toward an outlet conduit 118 opening into the base of the U-shaped channel 66. Preferably, the openings 116 are inclined relative to the base 36 to produce flow in the direction toward the outlet conduit 118 as indicated by the arrows 120 (FIG. 7).

Referring to FIG. 1, 2, 4 and 7, purging of the channel 66 will be apparent. In response to a timer or other suitable means, water is delivered from a source through the inlet 62 through the frame 102 below the plug 112 into the supports 106. The water exits through the openings 116 to produce flow toward the outlet conduit 118. The outlet conduit 118 may include a solenoid valve (not shown) which is opened in response to the timer, may include a liquid level control valve (not shown) which opens when the liquid level in the sump 64 rises or may be of an overflow or siphon arrangement which discharges water when the liquid level in the sump 64 rises to a predetermined level. In any event, means are provided to allow water to discharge through the outlet 118 in a timely manner while water is discharged into the channel to move debris toward the outlet 118.

Figure 8:
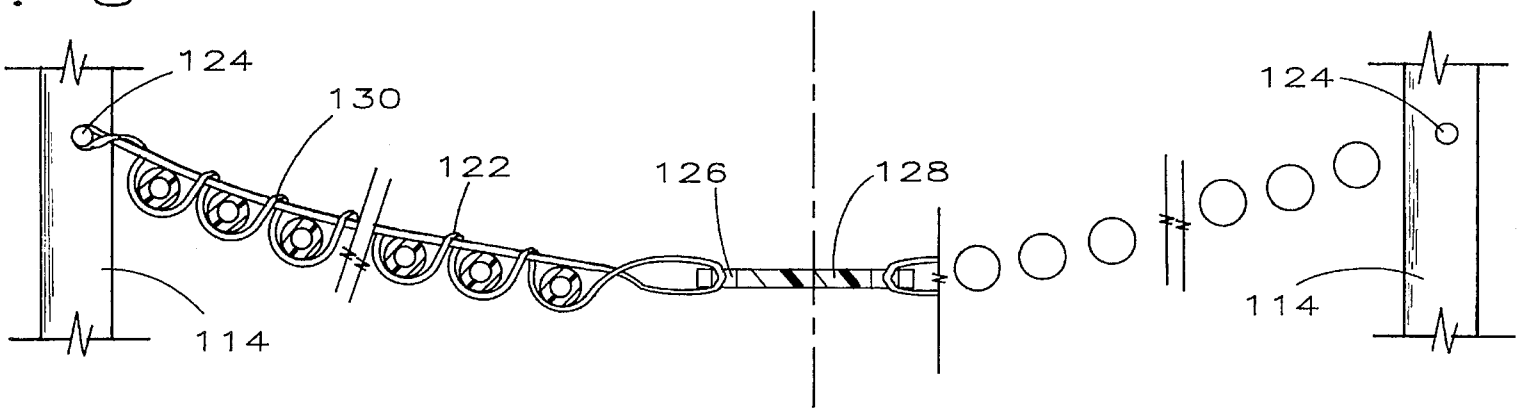
FIG. 8 is a cross-sectional view of one of the heat exchange coils showing a novel technique for suspending the coils.

Referring to FIG. 8, there is illustrated a novel technique for suspending the heat exchange coils 26, 28 in an upwardly concave or conical configuration. As disclosed in the copending application, it is desirable to allow the windings of the coils 26, 28 to expand, contract and move around in response to thermal growth of the metal tubing. To this end, a plastic coated wire 122 connects to a peg 124 on the vertical support 114 and loops around each of the coils windings and through an opening 126 in a central baffle plate 128. Although the plastic coated wire 122 may be of any suitable type, the preferred wire is a THHN insulated solid copper wire of 10–12 gauge. It is preferred that one of the support wires 122 extend from each corner of the rectangular frame 102 to connect to four equally spaced locations on the baffle plate 128. Although the lacing pattern may be of any suitable type, one simple technique is to loop the wire 122 under each of the coil windings, provide a loop 130 above and between each of the coil windings and then lace the wire 122 back and forth through the loops 130. This configuration provide a flexible support for the coils 26, 28 and allows the coil windings to expand, contract and move around in response to thermal growth and relaxation.

The water circulation system 32 shown in FIG. 6 should now be apparent. The circulation pump 132 is conveniently positioned outside the housing 22, has an inlet in the sump 64 and delivers circulating water to the water inlet 62.

Operation of the condenser 10 of this invention should be apparent. Hot gaseous refrigerant is circulated through the coils 26, 28 in response to operation of the refrigeration systems 12, 14, 16. In response to a load, such as sensed by a predetermined high temperature in one or more of the coils 26, 28 and/or a predetermined high pressure in one of the systems 12, 14, the fan 24 and/or a water circulation pump 132 start. Water sprays through the nozzles 104 to impinge on and wet the smooth tubing of the coils 26, 28. Water drips off the upper coils 26 into the media 30 or onto the next lower coil. The water is cooled by conduction, radiation, convection and evaporation although most of the heat loss in the condenser 10 is due to evaporation of the circulated water. In this fashion, condensing temperatures substantially below ambient are achieved. Water sprayed onto the lower coil 28 as well as that dripping off the media 30, if any, falls into the sump 64 and is recirculated. Water in the sump 64 is periodically purged by water influx through the purge system and overflow through the outlet 118 so mineral buildup in the circulating water is controlled. Any scale or particulate material falling into the sump 64 collects in the channel 66 and is swept toward the outlet structure 118 during the next purge cycle.

Figure 9:
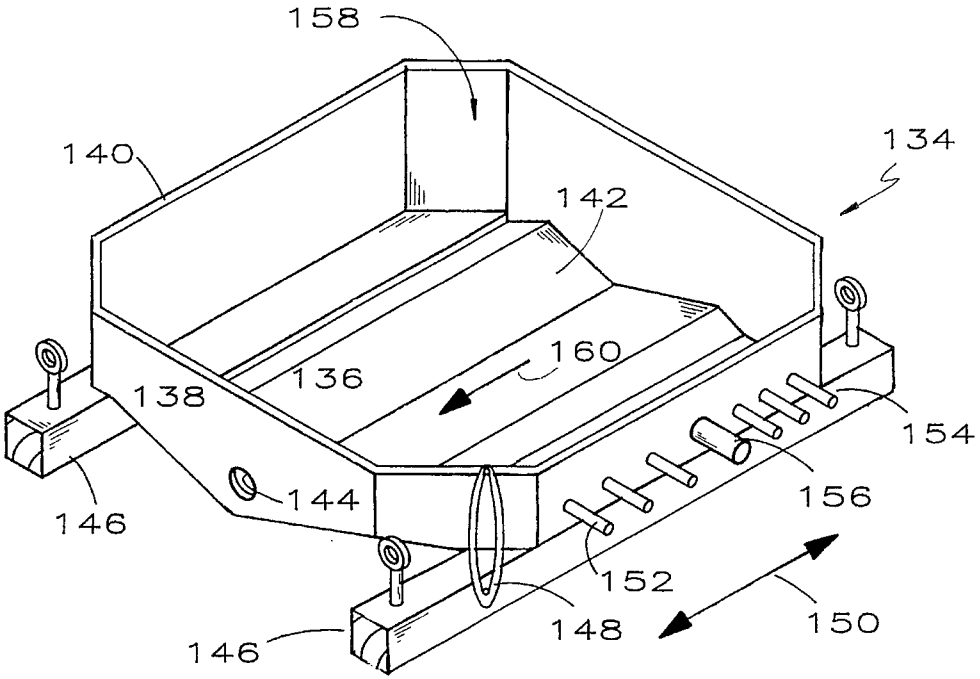
FIG. 9 is an isometric view of another embodiment of the housing base of this invention.

Referring to FIG. 9, a slightly different embodiment of the base 134 is illustrated. The base 134 comprises a bottom wall 136 and a short peripheral wall 138 having an outwardly offset lip 140 in a manner similar to the base 36. The bottom wall includes a central trough 142 having a drain opening 144 in one of the end walls.

A pair of wooden sills 146, such as 4"×4" treated lumber, extend parallel to the trough 142 and are secured to the bottom of the base 134 by straps 148, adhesive or the like. The sills 146 are spaced relative to the periphery of the bottom wall 136 so a pair of fork lift tines may be placed, preferably on the inside of the sills 146, but on the outside if desired. It will be seen the tines can extend between the sills 146 only if the tines are inserted in the direction shown by the double headed arrow 150. This is of considerable importance because the coolant inlet and outlet conduits 152, 154 and water inlet conduit 156 extend perpendicularly to the arrow 150. Thus, the arrangement of the sills 146 prevents a fork lift driver from trying to insert the tines in a direction that damages the conduits 152, 154, 156. The base 134 provides a sump 158 comprising part of the water circulation system. It will be seen the trough 142 operates in much the same manner as the channel 66 to discharge debris from the sump 158 when purging water is discharged into the sump 158. Preferably, the purging water is delivered in a direction shown by the arrow 160, i.e. directly toward the outlet opening 144. One or more lifting eyes 162 are provided on the sills 146 so the condenser may be lifted by a crane with a sling.

Although this invention has been described in its preferred forms with a certain degree of particularity, it is understood the present disclosure of the preferred forms is only by way of example and numerous changes in the details of construction and operation and in the combination and arrangement of parts may be resorted to without departing from the spirit and scope of the invention as hereinafter claimed.

I claim:

1. A condensing unit comprising a housing having therein a fan creating an upward path of air movement through the housing; a heat exchange coil having an inlet and an outlet for connection to a source of hot refrigerant in a refrigeration loop; a sump, below the coil, for collecting a coolant; and means in communication with the sump for spraying the coolant on the coil, the housing comprising a base having a bottom wall and an upturned rim, a plurality of upright walls supported by the base, means connecting the walls together and a top, the inlet and outlet extending laterally through the rim and then upwardly to the coil to allow the walls and top to be removed without affecting the coil; and a frame, in the housing, supported by the base bottom wall and being unconnected thereto and being movable relative thereto and having the heat exchange coil suspended therefrom, the frame being constrained against substantial lateral movement by the walls.

2. The condensing unit of claim 1 comprising the frame supported on the base independently of the walls and top and comprising a plurality of nested but unconnected modules, the coil being suspended from one of the modules.

3. The condensing unit of claim 2 wherein the base, the top, the walls and the modules are sized to individually pass through a 36" wide door.

4. A condensing unit comprising a housing having therein a fan creating an upward path of air movement through the housing; a heat exchange coil having an inlet and an outlet for connection to a source of hot refrigerant in a refrigeration loop; a sump, below the coil, for collecting a coolant; and means in communication with the sump for spraying the coolant on the coil, the improvement wherein the housing comprises a base, a plurality of upright walls supported by the base, means connecting the walls together and a top, the upright walls comprising inner and outer spaced panels extending from the base to the top providing a passage between the spaced panels having an air outlet opening into the base adjacent a junction of the base and walls and an air inlet opening through the outer panel, the inlet and outlet being arranged that a straight ray cannot pass into the air inlet opening and directly out of the air outlet opening.

5. The condensing unit of claim 4 wherein the outer panel provides an opening therethrough comprising the air inlet opening.

6. The condensing unit of claim 4 wherein the housing provides an interior chamber receiving the coil, the upright wall includes an upper end and a lower end, the air outlet opening being in the lower end, the upright walls being supported on the base to expose the lower wall end to the interior chamber.

7. A condensing unit comprising a housing having therein a fan creating an upward path of air movement through the housing; a heat exchange coil having an inlet and an outlet for connection to a source of hot refrigerant in a refrigeration loop; a sump, below the coil, for collecting a coolant; and means in communication with the sump for spraying the coolant on the coil, the improvement wherein the housing comprises a base having a bottom wall, a plurality of upright walls supported by the base, means connecting the walls together and a top, and a tubular frame, in the housing, supported by the base having the heat exchange coil suspended therefrom, the spraying means comprising a pump having an inlet in the sump and an outlet in communication with a first section of the tubular frame and a nozzle in communication with a second section of the tubular frame, the first and second tubular frame sections being in communication to deliver high pressure coolant from the pump to the nozzle.

8. The condensing unit of claim 7 wherein the frame is supported by the base bottom wall and being unconnected thereto and being movable relative thereto, the frame being constrained against substantial lateral movement by the upright walls.

9. The condensing unit of claim 7 wherein the frame is supported by the base bottom wall and being unconnected thereto and being movable relative thereto, the frame comprising a plurality of nested but unconnected modules, the coil being suspended from one of the modules, the top constraining upward movement of the frame modules.

10. A condensing unit comprising a housing having therein a fan creating an upward path of air movement through the housing; a heat exchange coil having an inlet and an outlet for connection to a source of hot refrigerant in a refrigeration loop; a sump, below the coil, for collecting a coolant; and means in communication with the sump for spraying the coolant on the coil, the improvement wherein the housing comprises a base having a bottom wall, a plurality of upright walls supported by the base, means connecting the walls together and a top, a frame, in the housing, supported by the base bottom wall and being unconnected thereto and being movable relative thereto and having the heat exchange coil suspended therefrom.

11. The condensing unit of claim 10 wherein the frame is constrained against substantial lateral movement by the upright walls.

12. The condensing unit of claim 10 wherein the base bottom wall comprises a plurality of shoulders abutting the frame and the frame is constrained against substantial lateral movement by the shoulders.

13. A condensing unit comprising a housing having therein a fan creating an upward path of air movement through the housing; a heat exchange coil having an inlet and an outlet for connection to a source of hot refrigerant in a refrigeration loop; a sump, below the coil, for collecting a coolant; and means in communication with the sump for spraying the coolant on the coil, the improvement wherein the housing comprises a base, a plurality of upright walls supported by the base, means connecting the walls together and a top, the base is of a single thickness of material including an interior having a bottom providing the sump and an exterior providing a U-shaped foot having a pair of parallel legs supporting the housing from an underlying ground surface and perpendicular toward a first side of the housing, the sump having a U-shaped recess on the interior of the single thickness of material, the recess being the reverse of the U-shaped foot;

the inlet and outlet being on a side of the housing other than the first side.

14. The condensing unit of claim 13 further comprises means for flushing debris from the sump along the recess comprising a water inlet adjacent a first leg of the U-shaped recess, a water inlet adjacent a second leg of the U-shaped recess and a water outlet adjacent a base of the U-shaped recess.

15. The condensing unit of claim 13 where the elongate parallel feet comprise a pair of elongate solid supports separate from the base and means connecting the supports to the base.

16. A condensing unit comprising a housing having therein a fan creating an upward path of air movement through the housing; a heat exchange coil having an inlet, a plurality of adjacent windings and an outlet for connection to a source of hot refrigerant in a refrigeration loop; a sump, below the coil, for collecting a coolant; and means in communication with the sump for spraying the coolant on the coil, the improvement comprising means for supporting the coil and allowing movement of a first winding toward and away from an adjacent winding in response to thermal growth and relaxation including a support on the unit and a flexible wire, in tension, suspending the coil from the support, the flexible wire extending around at least some of the windings, spacing at least some of the windings away from adjacent windings and attached to the support.

17. The condensing unit of claim 16 wherein the flexible wire comprises a metallic core and a plastic coating.

18. The condensing unit of claim 16 wherein the coil comprises an open center, a plate in the open center having a plurality of connections thereon, the flexible wire being secured to one of the connections, the coil being in an upwardly concave configuration.

19. The condensing unit of claim 18 comprising a plurality of flexible wires connected between the support and the plate.

20. The condensing unit of claim 18 wherein the flexible wire provides a series of first loops under each of the windings and a series of second loops between adjacent windings, and flexible wire extending from the support through the series of first and second loops to the plate connection and then through the second loops to the support.

21. A condensing unit comprising a housing having therein a fan creating an upward path of air movement through the housing;

a heat exchange coil having an inlet and an open center, a plurality of windings and an outlet for connection to a source of hot refrigerant in a refrigeration loop;

a sump, below the coil, for collecting a coolant; and means in communication with the sump for spraying the coolant on the coil;

means for supporting the coil including a plate in the open center having a plurality of connections thereon, a support on the unit and a flexible wire being secured to one of the connections and to the support.

22. The condensing unit of claim 21 wherein the coil is in an upwardly concave configuration.

* * * * *